US005336120A

United States Patent [19]

Maurer et al.

[11] Patent Number: 5,336,120

[45] Date of Patent: Aug. 9, 1994

[54] CONTROL SYSTEM FOR OPERATING A SHIP'S MOTIVE INSTALLATION

[75] Inventors: Gerhard Maurer; Manfred Braig, both of Friedrichshafen; Raimund Auer, Eriskirch; Christoph Goebel, Immenstaad; Josef Schwarz, Friedrichshafen; Thomas Voss, Tettnang, all of Fed. Rep. of Germany

[73] Assignee: Zahnradfabrik Friedrichshafen AG, Fed. Rep. of Germany

[21] Appl. No.: 937,903

[22] Filed: Oct. 13, 1992

[30] Foreign Application Priority Data

Apr. 14, 1990 [DE] Fed. Rep. of Germany ..... 4012107

[51] Int. Cl.[5] ..... B60K 41/00

[52] U.S. Cl. ..... 440/84

[58] Field of Search ..... 440/84, 85–87

[56] References Cited

U.S. PATENT DOCUMENTS 2,925,156 2/1960 Grant et al. .
3,653,476 4/1972 Allen et al. .
4,253,349 3/1981 Floeter et al. .
4,558,769 12/1985 Neisen .

FOREIGN PATENT DOCUMENTS 1276491 8/1968 Fed. Rep. of Germany .
3907841 9/1989 Fed. Rep. of Germany .
2231563 12/1974 France .
2194862 3/1988 United Kingdom .
88/08390 11/1988 World Int. Prop. O. .

OTHER PUBLICATIONS

Marine Engineer and Naval Architect, vol. 95, No. 1154 May 1972, "BBC bridge control for propulsion turbines", pp. 157–159, see p. 157.

*Primary Examiner*—Jesus D. Sotelo
*Attorney, Agent, or Firm*—Davis, Bujold & Streck

[57] ABSTRACT

The invention concerns a control system for operating a ship's motive installation (1, 2). Via a gearing (4) having adjustable clutches (67, 69) for forward and astern movement, an engine (3) drives a propeller shaft (7). Control and sensor devices (53, 54) are provided. With them the engine speed and the degree of slip of the clutches can be altered. With a control lever (13, 14) of a control post (9) a propeller shaft speed can be adjusted. A control electronics (21) defines the momentary operational condition by freely selecting from three possible operation conditions. The respective operation condition is defined depending on operational parameters to be observed of the engine (3) and/or the gearing (4). The control system is particularly adequate for use within a ship's multi-engine motive installations.

29 Claims, 3 Drawing Sheets

CONTROL SYSTEM FOR OPERATING A SHIP'S MOTIVE INSTALLATION

The invention concerns in general a control system for operating a ship's motive installation. The installation has at least one, preferably two, engines. Each engine of the motive installation drives a propeller shaft via a gearing having adjustable clutches for forward and astern movement. A specific speed of the propeller shaft can be produced by varying either the engine speed or the degree of slip of one of the clutches. For selecting the travel direction and speed of the ship, there is at least one control post (main post), but preferably several control posts (main and secondary control posts). The control posts are distributed over the ship in such a manner that from several existing cabins the most adequate can be selected as fit to travel at the moment. Control and sensor devices exist to alter the speed of the engine or of the propeller shaft. These can be, for instance, electromagnetically actuatable proportional valves (control devices) and, for instance, optically acting speed sensors (sensor devices).

BACKGROUND OF THE INVENTION

From the prior art, a control system for operating a motive installation (publication of the firm Sturdy Marine Division "Marine Digital Control System" masthead Sep. 21, 1988) is known. This concerns a motive installation having a port-side and a starboard-side engine which are operatively connected via a respective gearing with a port-side and a starboard-side propeller shaft. With each motive group are coordinated three adjusting devices (control means) for the throttle valve adjustment (throttle servo), for gear selection (gear shift servo) and for actuating an adjusting valve of a clutch (trolling valve servo). The control means enumerated are attached via an electric line connection to an electronic control mechanism (CPU). Another electric connection exists between the control posts and the control mechanism.

The ship's motive installation can be operated with the control system known already by the fact that from two possible operating mode bits, one mode bit is selected. In a first operating mode, one of the clutches (forward and astern movement) is completely engaged. The velocity of travel is produced by varying the engine speeds. In another mode of operation, one engine speed is maintained while the travel velocity of the ship is determined by the degree of slip of the clutches (trolling). Adjustable slip clutches for driving a ship forward and astern have been disclosed in DE-OS 21 20 639.

In another control system already known for operating a motive installation, a mode bit selector device is provided in which a specific manner of operation can be preselected. According to the manner of operation preselected, a certain function is associated with the control lever of the control post. When preselecting the travel mode bit (cruise control), the clutch for forward movement is engaged. The engine speed is varied with the control lever in order to adjust a specific travel speed. When the slow travel mode bit (troll mode) is preselected with the mode bit selector device, the function associated with the control lever is altered. As long as said mode bit is selected, the engine is operated at a specific, uniform speed. The travel speed is varied via the control lever in such a manner that the degree of slip of the respective clutch of the gearing is selected of a greater or lesser magnitude. The rate of revolution of the propeller shaft is thus varied via the degree of slip of the clutch. The known control system has at its disposal control electronics to which are attached an input and output unit, a display unit and control and sensor devices (see publication of the firm Twin Disc "Twin Disc Power Commander" masthead: 319 MEC 5M-1-88).

DE 39 07 841 A1 discloses exclusively a control apparatus for a ship's propulsion system which fundamentally coincides with the one above described. The control electronics consists of a main communication control mechanism and an auxiliary communication control mechanism. The port-side motive installation is controlled via the main control mechanism while the starboard-side motive installation is monitored by the auxiliary control mechanism. For this purpose, the port-side control levers of the control posts (main and secondary control posts) are attached to the main control mechanism while the control starboard-side control levers of the control posts (main and secondary control posts), respectively, have one electric connection to the auxiliary control mechanism. The main communication control mechanism is additionally connected with the auxiliary communication control mechanism via line connections. The control and sensor devices are each separately attached to the main control mechanism (on the port-side) and the auxiliary control mechanism (on the starboard-side). A mode selector device and a display unit are coordinated with each control lever.

The known control systems, which make it possible to operate a motive installation using control electronics, have the advantage that a precise regulation of specific nominal values (such as the engine speed and the propeller shaft speed) is possible. Despite the use of electronic parts, on the other hand, it has only been limitedly attained to facilitate to the user the operation of said systems. For the attachment of a control post two connecting lines are required which, when for instance using a total of six control posts, means that twelve line connections are always needed. To this must be added other line connections for interconnecting the control mechanism and attaching other functions (alarm, command keys for the post delivery and acceptance). It must further be borne in mind that the failure of the electronics does not always lead to the failure of both motive installations. The already known control systems in which a specific operating mode must be preselected require a certain measure of technical understanding for a faultless handling. On one hand, the operator not always has such a technical understanding to the desired extent and, on the other, it finally is another condition to have the ability to take into consideration other requirements and peculiarities when wiring such a ship's motive installation. For the above stated reasons, faulty conditions are not ruled out in the known control systems. This includes that the motive installation is not always operated as would be required and also possible in view of the given technical prerequisites.

SUMMARY OF THE INVENTION

This invention is based on the problem of improving a control system for operating a ship's motive installation of the kind above described in a manner such that engineering tools, electric and electronic expenses are kept small, that operation is facilitated and that the economy of installation as a whole is increased.

The problem on which the invention is based is solved by the fact that in the first place the propeller shaft speed and direction of rotation are adjustable with the control lever. Since only the propeller shaft speed (in one direction of rotation) is adjusted with the control lever, the operation of the control system is simplified so as to rule out a faulty handling. The propeller shaft speed and direction of rotation are adjusted by the control electronics—independently of the operator—so as to observe specific operation parameters of the engine and/or gearing. The operational parameters of the engine are, in the first place, the speed, the fuel consumption, the measurable fume emissions such as the $NO_X$ portion or the carbon black concentration of the exhaust gases. The operational parameters of the gearing to be observed are primarily the measured values from which the power loss of the gearing can be determined. Depending on the operational parameters to be observed, the control electronics defines a condition of operation in which the operational parameters of the engine and/or the gearing are closest to predetermined nominal values (resulting from characteristic lines or fields). In a possible condition of operation, the propeller shaft speed and direction of rotation are produced when the clutch is engaged by changing the engine speed. In another condition of operation, the propeller shaft speed and direction of rotation are produced at a given engine speed by changing the degree of slip of the clutch. The change between the individual operational conditions occurs automatically—absolutely unnoticed by the operator. The control system according to the invention allows optimal operation of a motive installation, taking into consideration different aspects. It is thus possible, for instance, to operate the motive installation at certain engine speeds optimating the consumption. At speeds at which, for instance, the fuel consumption of the engine does not play a decisive part, the motive installation can be operated in such a manner that the power loss of the gearing is specially small. When, for instance, there is the danger that the engine may stall during operation or that, for instance, exhaust gases having a great portion of carbon black particles to be emitted to the environment, the control electronics changes from the existing mode of operation, increases the engine speed and adjusts the propeller shaft speed by disengaging and allowing the clutch to slip. In other cases, a reverse procedure may be more logical. The traveling comfort is further increased by another step: the transition range of the clutch from its slipping condition to its completely engaged condition in which the clutch tends to vibrate (slip-stick) is eliminated, according to an advantageous feature, by the fact that the clutch in this transition range remains partially disengaged with a constant degree of slip and increased engine speeds.

In a particularly advantageous embodiment of the invention, several control posts are attached to a data bus connected with the control electronics. The control posts are in communicating connection with each other and connected with the control electronics by means of the proposed use of a bus system and thus via a single line. In principle, any desired number of control posts can be attached to said single line. It can be seen that the required expense in hardware is reduced to a minimum. By means of data transfer via the data bus, all information is always available at each control post.

According to another advantageous feature of the invention, the control electronics consists of an electronic control mechanism to which are attached the control posts via data bus and the control and sensor devices via connecting lines. Aside from an electric line which connects the electronic control device with the power supply system, only three connecting lines are attached to the control mechanism. This results in a simple, clearly arranged and very easily understandable construction at comparative low commercial expense. The use of a single control mechanism contributes the advantage that, in case of failure of the electronic system, it is ensured that the entire motive installation is no longer controllable—at least by means of the electronics. For emergency control, to which reference will be had in another passage, a mechanical control system is used in which at least one control lever of the main post is connected via a mechanical connecting cable with the engine and the gearing (mechanical back-up system).

The control mechanism advantageously contains a programmable memory for storing characteristic operational parameters for the operation of the engine and/or the gearing. Said operational parameters can be, for instance, limiting speeds of the engine and gearing, consumption values of the engine, exhaust gas emission values, pressure values (filter pressure, clutch pressure, lubricant pressure) etc. By virtue of the programmability of the memory, the values can be changed, which substantially makes easy the adjustment of the motive installation to different engine and gearing types or with regard to other specifications. In another embodiment of the invention, it is proposed that within the swivel range of the control lever there can be offered two ranges of propeller shaft speeds. It is advantageous to select the first range so as to be smaller than the entire range of possible propeller shaft speeds. The second range reaches up to the maximum possible propeller shaft speed. With the proposed step occurs an expansion of the regulating distance available for adjusting specific propeller shaft speeds by the control lever. When using conventional control levers which, departing from a neutral position, are movable in prow or stern direction by about 70° respectively, a higher resolution in certain speed ranges is obtained by the proposed step.

Each of the control posts has an input and output unit with command keys at its disposal. There is further a display field with which selector keys are coordinated. A specific function can be called at a time with one selector key.

It is particularly advantageous to use a numeric display field, since this makes possible the display of a large number of values. A specially easy to understand display is obtained if the selector keys are designed as illuminating keys. By flashing an actuated selector key an optical coordination with the operational value shown on the display field automatically appears. Accordingly, the operator is always reliably informed as to the kind and magnitude of the value shown.

In order to increase the clearness further, it is advantageous to coordinate illuminating keys with the display field. The illuminating keys show whether the operation values displayed are values of the engine or of the gearing. An illuminating key can be provided for showing inadmissible deviations from operation values (alarm function), size and place being defined by the actual light combination existing at the time.

In another embodiment of a control system for operating a ship's motive installation, it is proposed that up to a preselected propeller shaft speed, the adjustment of the control lever in a possible operating manner (docking) is without effect on the propeller shaft speed. This kind of operation is introduced by actuating an expressly provided command key of the input and output unit. It is specially convenient during said operation to indicate always on the display field a speed proportional to the engine speed. The propeller shaft speed is maintained at a presettable value by the control electronics via the control and sensor devices. This is done depending on at least one characteristic value of the engine, the clutch remaining constantly engaged or the degree of slip thereof being adjusted.

Since the engine speed during this kind of operation is displayed, it is in particular advantageous that at propeller shaft speeds below the usual engine idling speeds—considering the gearing step—up—the control electronics calculates one engine speed corresponding to the propeller shaft speed at the moment. Said calculated engine speed or the propeller shaft speed is then shown on the display field.

In another advantageous embodiment of the object of the invention, an operation condition that serves to warm up the engine can be adjusted. This operating condition is selected by actuating a command key of the input and output unit. It is a prerequisite that the control lever be in a neutral position. During this function, the gearing remains engaged in the neutral position. The engine speed can be changed via the control lever.

While maintaining the control and adjustment principle proposed according to the invention, the proposed control system can be completed by another function in the selection of which a delivery or acceptance of the function of the starboard-side control lever to the port-side control lever is effected preferably by the control electronics. The result is that the control of the drive system is then exclusively possible via the port-side control lever. The occurs when the starboard-side control lever reaches or exceeds the position corresponding to the position of the port-side control lever.

The control system proposed for operating a motive installation works with a data bus and at least one electronic control mechanism. In case of total failure of the electronics, the entire motive installation is no longer controllable, which in this case is in itself advantageous. Thus, it is possible to rule out wrong manipulations, interpretations or functions, which could possibly occur if the electronics would fail only partially. In order to be prepared for such an emergency situation, the control post, which normally allows control at one location, has at least one control lever which is connected via control cables with the control devices of the engine (throttle valve) and of the gearing (clutches for forward and astern movement).

BRIEF DESCRIPTION OF THE DRAWING(S)

Other features essential to the invention and the advantages resulting therefrom will be deduced from the description that follows of an embodiment of the invention. In the drawings.

DESCRIPTION OF THE PREFERRED EMBODIMENT(S)

General Arrangement

Figure 1:
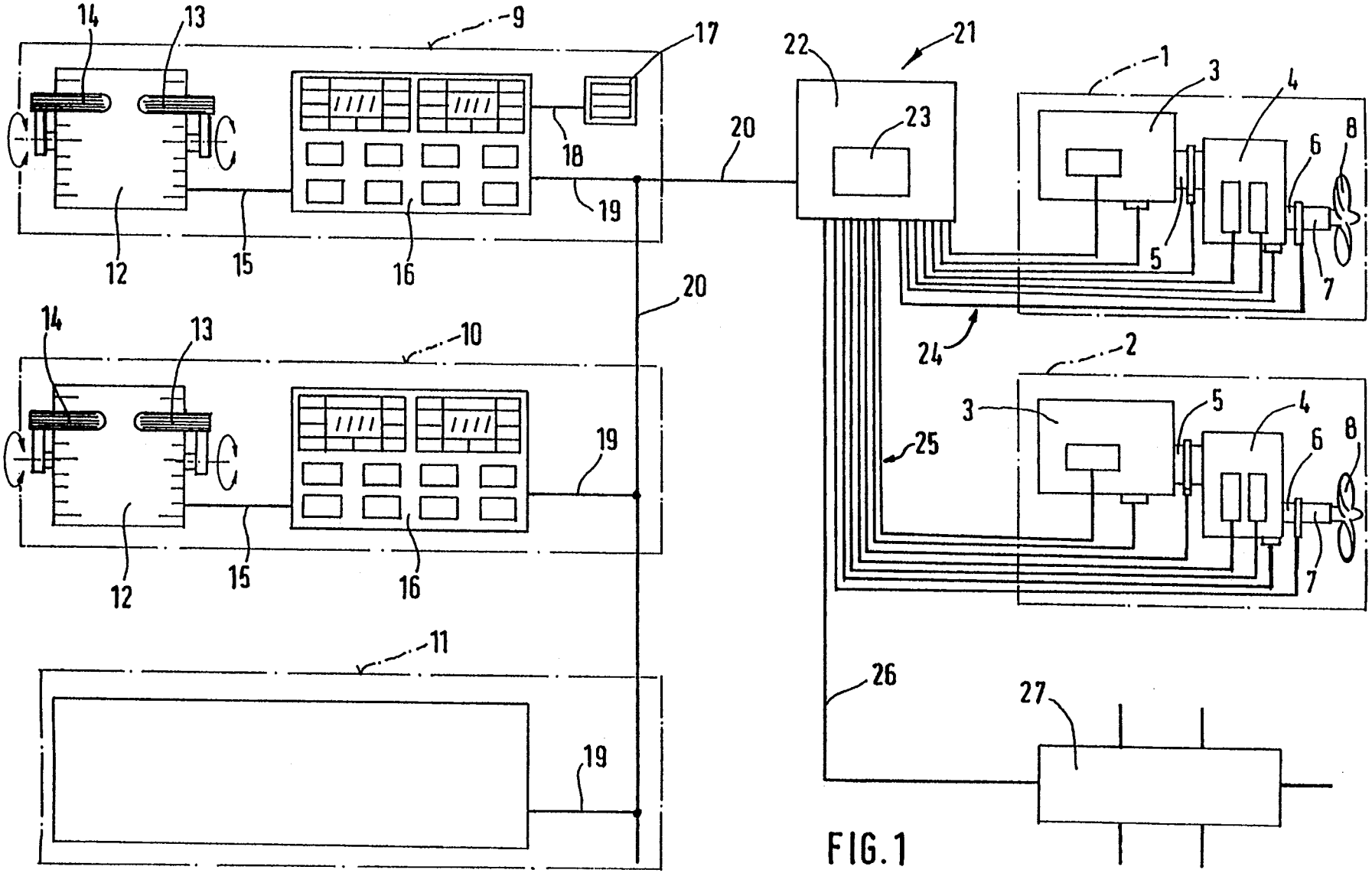
FIG. 1 is the fundamental design of a control system for operating a ship's motive installation in a greatly simplified diagrammatic illustration.

In FIG. 1 the fundamental design of a control system for operating a ship's motive installation can be seen. In the embodiment shown, the ship's drive is composed of a starboard-side motive installation 1 that is entirely marked by a dotted line and a port-side motive installation 2 (likewise marked by a dotted line). Each one of said motive installations 1 and 2 is constructed as follows:

An engine 3, such as a diesel engine, is operatively connected with a gearing 4. The gearing 4 can here be directly flanged on the engine 3 or the drive can be carried out via an intermediate shaft 5, like in the instant case. The gearing output shaft 6 is non-rotatably connected with a propeller shaft 7 which drives a propeller 8.

Since the modules of the port-side motive installation 2 basically coincide with that of the starboard-side motive installation 1, the same parts are provided with the same reference numerals.

The control system has several control posts of which a main control post 9 and two secondary control posts 10 and 11 are shown and highlighted by dotted lines.

Each one of the control posts 9, 10 and 11 basically consists of a console 12 with a starboard-side control lever 13 and a port-side control lever 14—referred to the travel direction of the ship.

The console 12 is attached, via a connecting line 15, to an input and output unit 16.

At least the main control post 9 has an input arrangement 17, attached via a cable 18, at its disposal. Although the secondary control posts 10 and 11 have no such input arrangement 17 it would, in principle, be easily possible to equip them with such a device.

Since the control posts 9, 10 and 11 have basically the same construction, coincident parts have been shown with the same reference numerals.

The main control post 9 and the secondary control posts 10 and 11, the same as secondary posts (not shown) added if necessary, are attached to a common data bus 20 via respective connecting lines 19. The connecting lines 19 are eliminated when the data bus 20 is directly passed (looped) through the control posts 9, 10 and 11. The data bus constitutes the (only) connection between the control posts 9, 10 and 11 and control electronics 21. The control electronics 21 is composed, in the embodiment shown, of an electronic control mechanism 22 and a programmable memory 23 (EEPROM). The programmable memory 23 serves to store characteristic operation parameters for the operation of the engine 3 and/or the gearing 4. Connecting lines 24 and 25 lead from the control electronics 21 to the motive installations 1 and 2 (the purpose of the connecting lines 24 and 25 will be explained in detail farther on).

A line 26 leads from the control electronics 21 to attaches the control electronics 21 to the power supply 27.

Console with Control Levers

The starboard-side control lever 13 and the port-side control lever 14 are movable ahead or astern of the ship out of the shown neutral position in which they point substantially vertically. The starboard-side control lever 13 is coordinated with the starboard-side motive installation 1 and the port-side control lever 14 is coordinated with the port-side motive installation 2. With the control levers 13 and 14, the operator adjusts the propeller shaft speed and direction of rotation of the starboard-side or port-side propeller 7. By moving the starboard-side control lever 13 forward, the starboard-side motive installation 1 is operated in a manner such that the propeller shaft 7 is driven in forward travel direction and at a speed dependent on the swivel position of the control lever 13. The same applies to the astern travel direction.

If the port-side control lever 14 is moved forward, the port-side motive installation 2 is operated in a manner such that the propeller shaft 7 thereof is driven in forward travel direction and at a speed dependent on the swivel path of the control lever 14. The same logically applies to the astern travel direction.

However, it is possible to operate both motive installations 1 and 2 synchronously by exclusively actuating the port-side or starboard-side control lever 14 or 13. The function of the starboard-side control lever 13 is here transferred to the port-side control lever 14 and taken over by the latter (synchronous operation).

For the sake of completeness, let it be mentioned that normally the main control post controls operation. Those control posts 9, or 10, or 11 whose control levers 13 and 14 set the propeller shaft speeds also allows operational control. The operational control, which is normally in the main control post 9, can be transferred to one of the secondary control posts 10 or 11 and vice-versa (post transfer). The conditions in which this is in particular possible are explained herebelow.

In a mode of operation (docking) which is selected when the ship is built, the position of the control levers 13 and 14 has no effect on the speed of the propeller shaft 7, at least up to a preselected propeller shaft speed. In this mode of operation, the propeller shaft speed is kept by means of the control electronics 21 at a presettable minimum value, depending on at least one characteristic value of the engine which is preferably the engine speed.

In another condition of operation, which serves to warm up the engines 3, the gearing 4 remains engaged in a neutral position. The engine speeds are changed via the control levers 13 and 14.

Input and Output Unit

Figure 2:
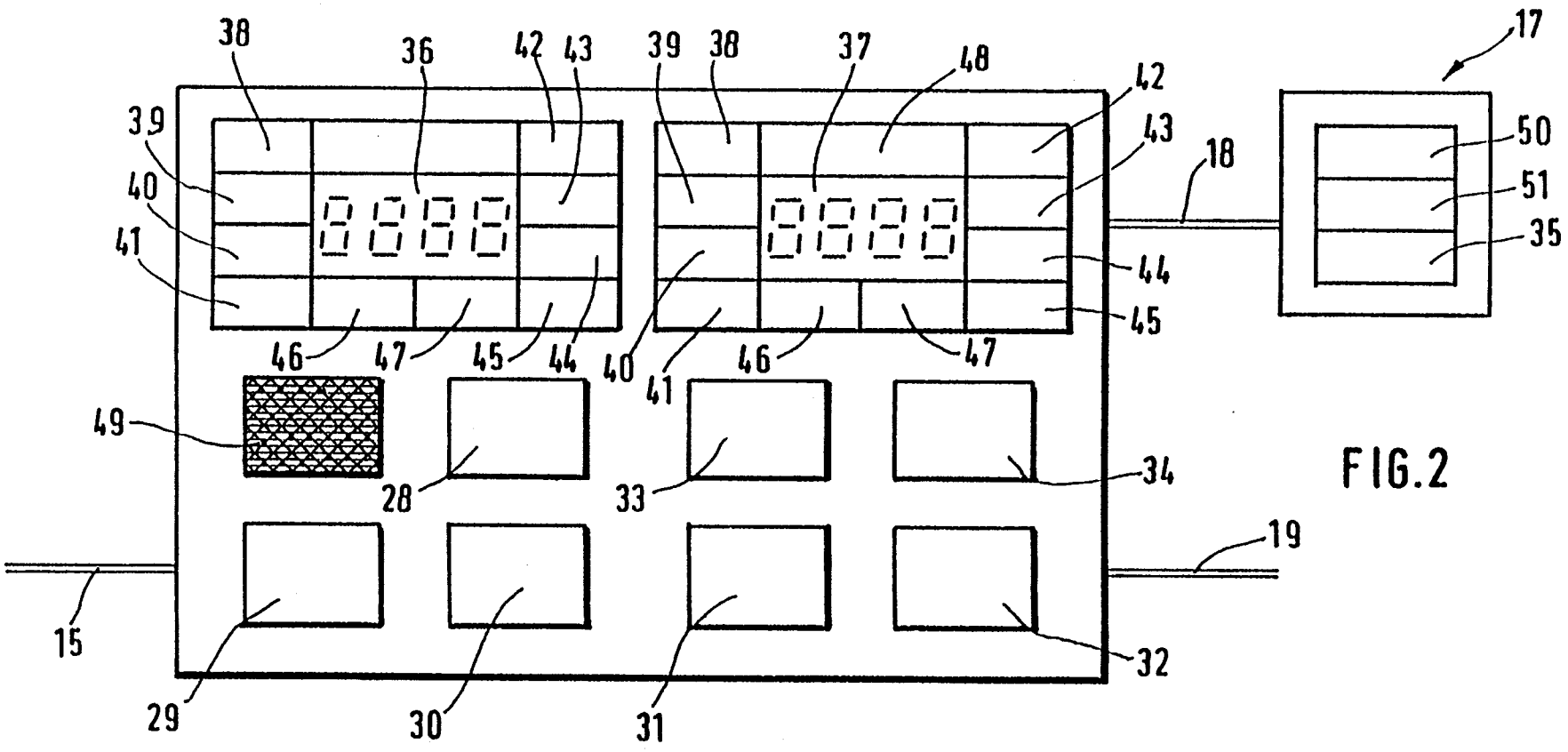
FIG. 2 is an input and output unit of a control system in a greatly simplified diagrammatic topview and FIG. 3 is the arrangement of FIG. 1 with control and sensor devices.

As already mentioned, an input and output unit 16 is an essential component of a control post. This applies both to the main control post 9 and to the secondary control posts 10, 11 and other secondary control posts not shown. Details of the arrangement of an input and output unit 16 are seen on FIG. 2. Connecting lines 15 and 19 and the cable 18 are attached to the input and output unit 16.

The input and output unit 16 has a series of command keys 28, 29, 30, 31, 32, 33 and 34. It is convenient to design the command keys 28 and 34 as illuminated keys since, by means of an illuminated key, the function engaged of the actual display is optically coordinated with the operator.

Command Key 28

This command key indicates the operational control of a control post. By pressing the command key 28, it is indicated that the operational control (which is normally in the main control post 9) has to be transferred and taken over. When the command key 28 of (another) operational control post is actuated, it starts to blink as a key designed as an illuminated key. The command keys 28 and the keys 29, or 30, or 31 start to blink on the remaining posts not controlling the ship. The possibility of take over by a post and the travel condition of the ship are thus indicated. When the command is now to be taken over on a control post, the key 28 must be actuated. The blinking light of the illuminated key 28 converts to a permanent light and the actual speeds are displayed. The control levers 13 and 14 must thereafter be changed to a position corresponding to the position of the control levers 13 and 14 of the post previously controlling operation. Only after this condition has been fulfilled is a transfer of the controlling operation acknowledged. The manner in which this takes place is that the key which indicates the ship's travel condition constantly glows while the analogous keys of the remaining control posts darken.

Command Key 29

As already mentioned above, for selecting the speed of the propeller shaft 7, only a limited swivel angle in a forward travel direction or an astern travel direction is available to each one of the control levers 13 and 14. But this means that the sensitivity with which adjustment operations can be effected is not always strong enough as in itself desired. By actuating the command key 29, it is possible to extract a specific range from a range of possible propeller shaft speeds from zero revolutions per minute up to a maximum revolutions per minute. Said specific range of possible propeller shaft speeds is smaller than the whole range of possible propeller shaft speeds. Assuming, by way of example, that the range of possible propeller shaft speeds extends from zero revolutions per minute up to 6000 revolutions per minute, it is possible, for instance by actuating the command key 29, to extract a speed range of from zero revolutions per minute to 2000 revolutions per minute. The whole swivel path of the control levers 13 and 14 is then available for said speed range for adjustment purposes. For practical requirement, it can be enough to extract only one speed range in a forward travel. But it is likewise possible to provide the step described for the astern travel range. In other words, with the actuation of the command key 29, the lower speed range is, so to speak, expanded in order to enlarge the adjustment sensitivity. But the same objective can also be attained in purely mechanical ways. For instance, if a mechanical step up of the setting movement and the production of an electric output signal, associated therewith, were possible in a manner such that in a lower speed range, a relatively large regulating distance, and in an upper speed range, a relatively small regulating distance, were required to produce equal speed changes.

Command Key 30

By actuating the command key 30, the whole range of possible propeller shaft speeds is coordinated with the swivel path of the control levers 13, 14. The ranges of possible propeller speeds can also be adjusted so that a lower speed range is coordinated with the command key 29 and the—adjacent—upper speed range is coordinated with the command key 30.

Command Key 31

The function of the starboard-side control lever 13 can preferably be transmitted to the port-side control lever 14 by the control electronics so that the motive installations 1 and 2 are exclusively controlled via the port-side control lever 14 (synchronous operation). By pressing the command key 31, said function is selected. The key then blinkingly lights up. The transfer is automatically effected when the starboard-side control lever reaches or exceeds the position corresponding to the position of the port-side control lever. The blinking light then converts to steady light. To quit this mode of operation, a new pressing of the command key 31 and a transfer of both control levers 13, 14 to the neutral position are required. Surprising or dangerous operation conditions are ruled out by transferring the control levers to the neutral position.

Command Key 32

A "docking" mode of operation of the drive system can be selected with the command key 32. In this mode of operation, the position of the control levers 13 and/or 14, at least up to a preselected propeller shaft speed, has no effect on the speed of the propeller shaft 7. The speed of both propeller shafts is adjusted to a presettable value by the electronics 21.

Command Key 33

The presettable value of the propeller shaft speed (see what has been said above) can be lowered by the command key 33.

Command Key 34

By actuating the command key 34, the presettable value of the propeller shaft speed can be peaked.

When the command key 32 is pressed, a speed analogous to the engine speed is always shown on the display field. Insofar as the propeller shaft speed exceeds the usual idling speed of the engine—taking into consideration the gearing step up—the control electronics computes a corresponding theoretical engine speed and shows it on the display field.

The "docking" mode of operation is abandoned in the neutral position of the control lever 13, 14 by actuating another command key 29, or 30, or 31. Here the propeller shaft speed last adjusted is stored in the memory 23 and is automatically adjusted again when this mode of operation is called once more.

Warming Up of the Engine

As already explained, at least the main control post 9 has an input arrangement 17. Here another command key 35 is provided with which an operation mode which serves to warm up both engines 3 can be controlled. When said command key 35 is pressed, the control electronics 21 ensures that the gearing 4 remains engaged in a neutral position. The engine speed can be changed via the control levers 13 and 14. This operation condition is abandoned when one of the remaining command keys 28 to 34 of the input and output unit 16 is actuated during which the control levers 13 and 14 must be in a neutral position.

Display Functions

Each input and output unit 16 has numeric display fields 36 and 37. The display field 36 is coordinated with the port-side motive installation 2 and the display field 37 with the starboard-side motive installation 1. They are preferably LCD displays. Selector keys 38, 39, 40 and 41, the same as 42, 43, 44 and 45, group around the display fields 36 and 37. The other selector keys 46 and 47 join up with the lower longitudinal side of the display field 37. All selector keys 38 to 47 are designed as illuminating keys. An illuminating key 48 joins up with the upper longitudinal side of the display field 37. Said key glows in case of inadmissible deviations from certain operational parameters of the engines 3 and/or the gearing 4 (alarm function). Said key serves to abandon the alarm or to step up the display when several alarms are activated simultaneously.

Since the arrangement of the selector keys, which are coordinated with the display field 36, is made in analogous manner, said selector keys are provided with the same reference numerals. The following operational parameters which refer to the starboard-side motive installation 1 are separately coordinated with the selector keys:

selector key 38: revolution per minute of the engine 3;
selector key 39: cold water temperature of the engine in °C. or °F.;
selector key 40: lubricant pressure of the engine 3 in bar or psi;
selector key 41: charging voltage in volts.

By lighting up the selector key 46, it is indicated that the value shown on the display field 37 is a characteristic value of the engine.

selector key 42: speed per minute of the propeller shaft 7;
selector key 43: temperature of the gearing 4 in °C. or °F.;
selector key 44: clutch pressure in bar or pi and
selector key 45: filter pressure in bar or psi.

By lighting up the selector key 17, it is indicated that the values shown on the display field 37 are characteristic values of the gearing.

The above description covering of the selector keys 28 to 47 and the function of the illuminating field 48 coincidently applies to the port-side motive installation 2.

The function of the selector keys 38 to 47, combined with the display fields 36 and 37, will be explained with two examples:

When, for instance, the voltage of the port-side motive installation 2 is to be scanned, the selector key 41 coordinated with the display field 36 is pressed. In the selector field the value of the voltage is numerically shown. Since this is a characteristic value of the engine, the selector key 46 coordinated with the display field 36 additionally lights up.

When, for instance, the speed of the starboard-side propeller shaft 7 has to be shown, the selector key 42 coordinated with the display field 37 is actuated. The key starts to glow and on the display field the number of revolutions per minute is numerically shown. Since this is a characteristic value of the gearing, the selector key 47 additionally lights up.

The input and output unit 16 is further equipped with an electric horn 49 which can be activated with an acoustic alarm.

Input Arrangement

Together with the already mentioned command key 35, the input arrangement has other illuminating keys 50, 51 and 52. Their functions are as follows:

Illuminating Key 50

The control electronics makes available specific condition data. Said condition data can be shown on the display fields 36 and 37. The display of the condition data is selected by actuating the illuminating key 50 and the illuminating keys 46 or 47. A specific code number can be adjusted via the command keys 33 and 34.

Illuminating Key 51

By actuating the illuminating key 51, the condition data adjusted by the above described selection of the code number are displayed, or the adjusted parameter values are programmed.

Adjustment/programming

The control electronics is adjusted or programmed by actuating the illuminating key 50. A specific code number is adjusted on the display field 36 or 37 via the keys 33 and 34 and is acknowledged by actuating the illuminating key 51. The control electronics 21 is now in the programming mode and allows no more travel operation. The input of the operational parameters or of the adjustment values takes place in the manner described in the programming mode. Here each operational parameter has coordinated its own code number (identifier).

However, it is alternatively possible also to preprogram the programmable memory 23—according to the system layout—with specific operational parameters and thus to equip the control electronics 21 depending on type and case.

Control and Sensor Devices

Figure 3:
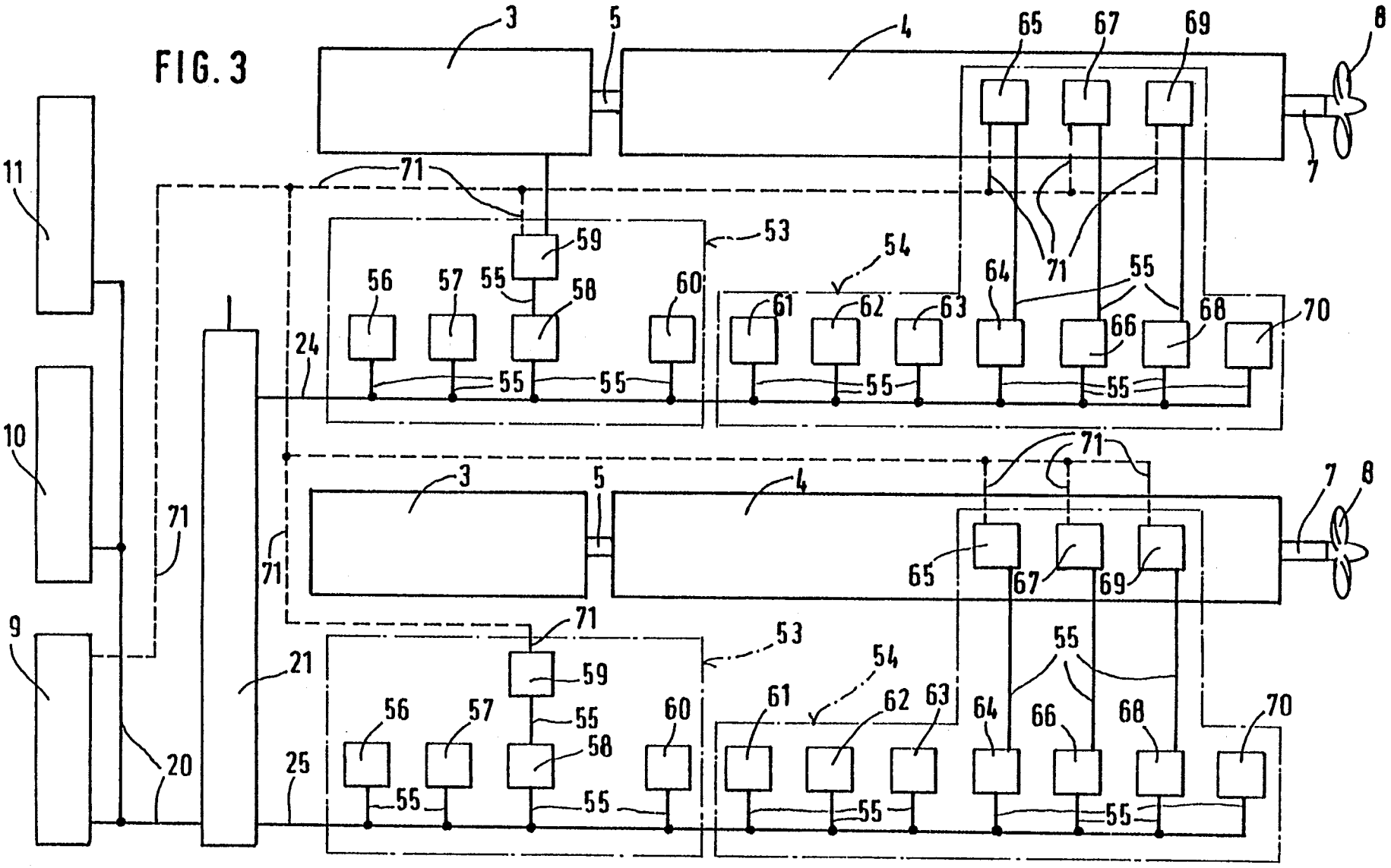

The diagram of the control system shown in FIG. 3 for operating the motive installations 1 and 2 essentially corresponds to the one of FIG. 1. The existing control and sensor devices of the starboard-side motive installation 1 are now explained with reference to said diagram. Since the control and sensor devices for the port-side motive installation 2 are coincidently designed, the same reference numerals are used for corresponding parts.

The control posts 9, 10 and 11 are attached to the data bus 20 via the connecting lines 19. The data bus is connected with the control electronics 21. Connecting lines 24 and 25 lead from the control electronics 21 to the motive installation 1 and to the motive installation 2. The connecting line 24 leads, more precisely said, to control and sensor devices 53 (summarily marked by the edge of a dotted line) of the engine 3 and to control and sensor devices 54 (likewise summarily comprised by the edge of a dotted line) of the gearing 4.

The control and sensor devices 53 of the engine 3 are composed as follows:

From the link circuit 24, a connecting line 55 leads respectively to a temperature sensor 56, which monitors the temperature of the cold water, to a pressure sensor 57, for measuring the lubricant pressure, and to a converter 58, which changes the digital input signal to analogous electric output signals. The converter 58 is connected with a setting cam 59 of the engine 3. The setting cam 59 serves to adjust the part provided for supplying the fuel of the engine 3. This can be, for instance, a throttle valve or the flow rate regulator of an injection pump of a diesel engine. The speed of the engine 3 is detected by means of a speed sensor 60. The construction of the sensors used is not limited to a specific type. The speed sensor 60 can operate, for instance, optically, magnetically or inductively.

Characteristic operational parameters of the engine can be detected or changed with the control and sensor devices of the engine 3 consisting of the temperature sensor 56, the pressure sensor 57, the converter 58, the setting cam 59 and the speed sensor 60. The position of the throttle valve or of the low rate regulator of the injection pump of a diesel engine combined with the speed of the engine is a standard for the fuel consumption. The remaining values allow other conclusions regarding the system condition. The characteristic operation parameters detected are continuously communicated to the control electronics 21.

The control and sensor devices of the gearing 4 are constructed as follows:

A temperature sensor 61 measures the temperature of the gearing (by measuring the temperature of the oil charge). A pressure sensor 62 serves to detect the clutch pressure. Another pressure sensor 63 detects the filter pressure. A converter 64 acts together with a clutch pressure setter 65. The converter 64 changes digital signals to analogous electric output signals. In this manner, the clutch pressure setter 65 is adjusted so that the clutch pressure can be altered. The consequence of this is a degree of slip of different magnitude of the oil-hydraulically actuatable clutches for the forward and astern movement. A converter 66 is coordinated with a clutch 67 for the forward movement. As mentioned already, the clutch 67 is constructed as multi-disc and oil-hydraulically actuatable clutch. The clutch can be opened or completely engaged. Due to the adjustability of the clutch pressure, the degree of slip can be altered at will so that, for instance, the speed of the propeller shaft 7 can fall far below the engine speed—also taking into account the step-up ratio of the gearing 4.

A converter 68 serves to actuate a clutch 69 for astern movement. The control and sensor devices of the gearing 4 are completed by a speed sensor 70 with which the speed of the propeller shaft 7 is detected. To the sensors used applies, moreover, that they are not limited to a specific design. The expert can select adequate sensors from the multiplicity of possible designs.

Characteristic operational parameters of the gearing 4 can be detected or changed with the control and sensor devices 54 of the gearing 4 consisting of the temperature sensor 61, the pressure sensors 62 and 63, the converter 64 and clutch pressure setter 65, the converter 66 and the clutch 67 for forward movement, the converter 68 and the clutch 69 for astern movement and the speed sensor 70 for detecting the speed of the propeller shaft 7. To said characteristic operational parameters belong, for instance, the input and output speed of the gearing, the power loss of the gearing and the valve of the clutch pressure. Important conclusions as to the system condition of the gearing 4 can be arrived at from the characteristic operational parameters. The operational parameters detected are constantly communicated to the control electronics 21.

The characteristic operation parameters of the engine 3 and of the gearing 4 communicated to the control electronics 21 are processed by said electronics according to given histories. The operational parameters of the engine 3 and of the gearing 4 can be combined in order to be able to arrive at conclusions as to the system condition of the motive installations 1 and 2.

Emergency Control

The control system described for operating the motive installations 1 and 2 is equipped with an emergency control in order to be able, at least to a limited extent, to control the ship in case of a possible failure of the electronics. For this purpose, at least one control lever, is provided for each motive installation 1 and 2, which is connected, via control cables 71 marked in FIG. 3 with broken lines, with the setting cam 59 of the engine 3, the clutch pressure setter 65 and the clutches 67 and 69 of the gearing 4. This precaution ensures that the ship be not immobilized even in emergency situations.

Function

The operator adjusts the speeds of the propeller shaft 7 by the control levers 13 and 14. The adjusted speed is regulated by the control electronics 21 in a special manner:

Depending on the operational parameters to be observed of the engines 3 and of the gearing 4, which orient themselves following given regulation strategies, the control electronics 21 defines an operating condition freely, that is, without being altered by the operator. Said condition can correspond to an operational condition in which the speed of the propeller shaft 7, when the clutch 67 or 69 is engaged, is produced by changing the speed of the engine 3. But the control electronics 21 can also produce an operational condition in which the speed of the propeller shaft 7 is produced at a given speed of the engine 3 by changing the degree of slip of the clutch 67 or 69. The control electronics 21 selects and determines that operational condition in which the motive installations 1 and 2 are in a system condition that comes as close as possible to the given characteristic operational parameters of the engine 3 and/or the gearing 4 or coincides with them. Together with the operational conditions mentioned, the transition range plays a part characterized by the performance of the clutch 67 or 69. In said transition range, the clutch (67 or 69) is in the zone between a slipping and an engaged condition. Under these circumstances, the clutch inclines to vibrate (slip-stick) which makes itself noticeable together with the jerky disengaging and engaging, specially by a hammering noise. In order to eliminate this undesirable behavior, it can be advantageous to leave the clutches 67 and 69 disengaged in this transition range with a constant degree of slip and to increase the engine speed. As soon as the propeller shaft has reached a speed above an engine minimum speed and, in which a vibration of the clutch 67 or 69 is eliminated, the clutch can be "connected through", that is, engaged. This task can be readily assumed by the control electronics 21. An extremely simple operation is ensured with the explained control system. This operation normally disappears in the swivel of both control levers 13 and 14. Despite this extremely simple operation and the comfort resulting therefrom, an operation of the motive installations 1 and 2 is possible which does justice to every technical and economic demand which can be mae of such a ship drive. Under all circumstances, the motive installations 1 and 2 can be operated appropriately and also very economically and with protection to the environment in relation to the intended use. Also of great advantage is that the operation expense is relatively low with regard to technical implementation and wiring. The control system is neatly constructed and clearly arranged. This means a high flexibility on the side of the manufacturer and an operational, economic and safe idea on the side of the user.

| Reference Numerals | |
|---|---|
| 1 motive installation | 36 display field |

-continued

| Reference Numerals | |
|---|---|
| 2 motive installation | 37 display field |
| 3 engine | 38 selector key |
| 4 gearing | 39 selector key |
| 5 intermediate shaft | 40 selector key |
| 6 gearing output shaft | 41 selector key |
| 7 propeller shaft | 42 selector key |
| 8 propeller | 43 selector key |
| 9 main control post | 44 selector key |
| 10 secondary control post | 45 selector key |
| 11 secondary control post | 46 selector key |
| 12 console | 47 selector key |
| 13 starboard-side control lever | 48 illuminating key |
| 14 port-side control lever | 49 horn |
| 15 connecting line | 50 illuminating key |
| 16 input and output unit | 51 illuminating key |
| 17 input arrangement | 52 illuminating key |
| 18 cable | 53 control and sensor devices of the engine 3 |
| 19 connecting line | 54 control and sensor devices of the gearing 4 |
| 20 data bus | 55 connecting line |
| 21 control electronics | 56 temperature sensor |
| 22 electronic control mechanism | 57 pressure sensor |
| 23 programmable memory | 58 converter |
| 24 link circuit | 59 setting cam |
| 25 link circuit | 60 speed sensor |
| 26 line | 61 temperature sensor |
| 27 power supply | 62 pressure sensor |
| 28 command key | 63 pressure sensor |
| 29 command key | 64 converter |
| 30 command key | 65 clutch pressure of setter |
| 31 command key | 66 converter |
| 32 command key | 67 clutch/forward travel |
| 33 command key | 68 converter |
| 34 command key | 69 clutch/astern travel |
| 35 command key | 70 speed sensor |
| | 71 control cable |

We claim:

1. A control system for operating at least a first motive installation (1, 2) of a ship, said at least first motive installation (1, 2) having an engine (3) being drivingly connectable, for forward and astern movement, to a propeller shaft (7) via a transmission (4) with adjustable clutches (67, 69), said control system comprising:

control and sensor devices (53, 54) for varying the speed of the engine and a degree of slip of said clutches (67, 69);

at least one control post (9, 10, 11) for selecting a direction of travel of the ship and a rotational speed of the propeller shaft, said at least one control post having at least one control lever (13, 14) for controlling the travel direction and propeller shaft speed; and control electronics (21) for processing input and output signals;

wherein said at least one control lever (13) adjusts the speed and the rotational direction of the propeller shaft, said control electronics (21) freely defines, depending on operational parameters to be observed by at least one of said engine (3) and said transmission (4), an operating condition in which the propeller shaft speed and the rotational direction are produced by one of: (a) engaging one of said clutches (67 or 69) and changing the speed of the engine, and (b) operating the engine at a given engine speed and changing a degree of slip of one of said clutches (67, 69).

2. A control system according to claim 1, wherein in a transition range between a slipping condition and an engaged condition said clutches (67, 69) remain at least partially disengaged, via said control electronics (21), with a constant degree of slip and the engine speed is increased.

3. A control system according to claim 1, wherein a data bus (20) is connected with said control electronics (21) and a plurality of control posts (9, 10, 11) are connected to said data bus (20).

4. A control system according to claim 3, wherein said control electronics (21) comprises at least one electronic control mechanism (22), said plurality of control posts (9, 10, 11) are connected to said at least one electronic control mechanism (22) via said data bus (20), and said control and sensor devices (53, 54) are connected to said at least one electronic control mechanism (22) via connecting lines (24, 25).

5. A control system according to claim 4, said electronic control mechanism (22) contains a programmable memory (EEPROM 23) for storing parameters for operation of at least one of said engine (3) and said transmission (4).

6. A control system according to claim 1, wherein said at least one control lever (13, 14) is movable from a neutral position to both a forward end position and an astern end position and, within an available range of movement of said control lever (13, 14) for at least for the forward travel operation, first and second ranges of propeller shaft speed are attainable, whereby said first range is less than an entire range of the possible propeller shaft speeds and said second range is at least a remaining portion of the entire range of the possible propeller shaft speeds.

7. A control system according to claim 1, wherein said at least one control post (9, 10, 11) has an input and output unit (16) with a plurality of command keys (28, 29, 30, 31, 32, 33, 34) by which a desired mode of operation of said at least one motive installation (1, 2) is selected, and said at least one control post (9, 10, 11) has at least one display field (36, 37) with a plurality of selector keys (39, 40, 41, 42, 43, 44, 45) coordinated with said command keys for selecting display of a desired operational parameter of at least one of said engine (3) and said transmission (4).

8. A control system according to claim 7, wherein said at least one display field (36, 37) is a numeric display and said plurality of selector keys (39 to 45) are illuminateable keys so that, by lighting up a selected selector key (39 to 45), an optical coordination with a operational parameter displayed on said at least one display field (36) results.

9. A control system according to claim 7, wherein illuminating keys (46, 47) are coordinated with said at least one display field (36) to reveal one of whether an operational parameter displayed by said at least one display field (36, 37) refers to one of said engine (3) and said transmission (4) and whether an inadmissible deviation from said displayed operational parameter exists.

10. A control system according to claim 7, wherein said plurality of selector keys (39 to 45) are illuminateable keys such that each of said plurality of selector keys flashes, upon selection, to produce an optical indication as to the type of operational parameter being displayed.

11. A control system according to claim 7, wherein a first selector key (39 to 45), when actuated, produces a display of the engine speed, a second selector key (39 to 45), when actuated, produces a display of cold water temperature of the engine, a third selector key (39 to 45), when actuated, produces a display of lubricant pressure of the engine, a fourth selector key (39 to 45), when actuated, produces a display of voltage of the engine, a fifth selector key (39 to 45), when actuated, produces a display of propeller shaft speed, a sixth selector key (39 to 45), when actuated, produces a display of a temperature of the transmission, a seventh selector key (39 to 45), when actuated, produces a display of clutch pressure and an eighth selector key (39 to 45), when actuated, produces a display of filter pressure.

12. A control system according to claim 7, wherein said first motive installation (1) is a port-side installation and the ship includes a second starboard-side motive installation (2) which has a starboard-side engine (3), a starboard-side transmission (4) and a starboard-side propeller shaft (7); said at least one control post (9, 10, 11) has a starboard-side control lever (13) and a port-side control lever (14) for adjusting the speed and the rotational direction of said starboard-side propeller shaft (7) and said port-side propeller shaft (7), and one of said plurality of command keys (31), when actuated, effects via said control electronics (21) transfer and takeover of the function of said starboard-side control lever (14) to said port-side control lever (13) so that said port-side control lever (13) exclusively controls both propeller shafts.

13. A control system according to claim 12, wherein the transfer and takeover of the function of said starboard-side control lever (14) to said port-side control lever (13) only occurs once said starboard-side control lever (14) reaches a equivalent control position to that of said port-side control lever (13).

14. A control system according to claims 12, wherein one of said plurality of command keys (31), upon actuation, blinks during transfer and is continuously illuminated once the transfer and takeover of the function of said starboard-side control lever (14) to said port-side control lever (13) has occurred and darkens when both said control levers (13, 14) are moved to their respective neutral positions.

15. A control system according to claim 7, wherein said plurality of control posts (9, 10, 11) are situated at different locations on the ship, each of said plurality of control posts (9, 10, 11) has an input and output unit (16) and each input and output unit (16) has one of said plurality of command keys (28) which, upon actuation, indicates a possible transfer of operational control to a desired one of said plurality of control posts and by actuating a similar one of said plurality of command keys (28) at the desired one of said other control posts (9 or 10 or 11), the transfer of operational control is effected by said control electronics (21) once said control lever (13, 14), of the control post to which control is to be transferred, is adjusted to a position corresponding to a control position of the control lever (13, 14) of the control post (9 or 10 or 11) previously providing operational control.

16. A control system according to claim 15, wherein during a possible transfer of operational control from one said control post (9, 10, 11) to another said control post, said one of said plurality of command keys (28) flashes until acknowledgement of the transfer of operational control to said another control post and, after acknowledging takeover of operational control by said another control post, said one of said plurality of command keys (28) of the control post now controlling operation constantly glows while the remaining command keys (28) of the control post previously controlling operation darken.

17. A control system according to claim 16, wherein upon transfer of operational control from one control post to another control post, the propeller shaft speed is blinkingly displayed by said at least one display field (36, 37).

18. A control system according to claim 1, wherein one of said at least one control post (9, 10, 11) is a main control post (9) and said main control post (9) has at least one control lever connected, via control lines (71), to control devices of said engine (3) and of said transmission (4) for controlling driving power of the ship.

19. A control system according to claim 1, wherein the operational parameters of at least one of said engine (3) and said transmission (4) are detected by sensing devices communicating with said control electronics.

20. A control system according to claim 1, wherein said control system includes a second motive installation (1) having an engine (3) drivingly connectable, for forward and astern movement, to a propeller shaft (7) via a transmission (4), and said at least one control post (9, 10, 11) has a joy-stick which controls both said first motive installation (1) and said second motive installation (2).

21. A control system for operating at least one motive installation (1) of a ship, said at least one motive installation (1) having an engine (3) being drivingly connectable, for forward and astern movement, to a propeller shaft (7) via a transmission (4) with adjustable clutches (67, 69), said control system comprising:

control and sensor devices (53, 54) for varying engine speed and a degree of slip of said clutches (67, 69);

at least one control post (9, 10, 11) for selecting a direction of travel and a velocity of the ship by actuating at least one control lever (13); and control electronics (21) for processing input and output signals;

wherein during a docking manner of operation of said at least one motive installation (1, 2), the position of said at least one control lever (13) has no effect upon the propeller shaft speed, at least up to a preselected propeller shaft speed, and the rotational speed of said propeller shaft is maintained by said control electronics (21), via said control and sensor devices (53, 54), at a preset minimum value such that, depending on at least one characteristic of said engine (3), one of said clutches (67, 69) one of: (a) remains constantly engaged and (b) has the degree of clutch slip adjusted.

22. A control system according to claim 21, wherein said at least one characteristic of said engine (3) is engine speed.

23. A control system according to claim 21, wherein the manner of operation of said at least one motive installation (1, 2) is selectable by actuating a command key (32) of an input and output unit (16) and the engine speed is always displayed by a display field (36, 37) of said input and output unit (16).

24. A control system according to claim 23, wherein during operation at a desired propeller shaft speed which, taking into account the gearing located between the engine and the propeller shaft, is below a normal engine idling speed, said control electronics (21) computes an acceptable engine speed corresponding to the desired propeller shaft speed, appropriately adjusts the slip of said clutches and displays the computed engine speed on said display field (36, 37).

25. A control system according to claim 23, wherein said input and output unit (16) has two keys (33, 34) by which the propeller shaft speed can be altered, during operation, to one of a higher value and a lower value.

26. A control system according to claim 21, wherein a mode of operation of the ship is abandonable, when said at least one control lever is in a neutral position, by actuating another desired command key.

27. A control system according to claim 26, wherein a previous speed of a desired manner of operation is stored in memory and automatically recalled again when that desired manner of operation is again selected.

28. A control system for operating at least a first motive installation (1, 2) of a ship, said at least first motive installation (1, 2) having an engine (3) being drivingly connectable, for forward and astern movement, to a propeller shaft (7) via a transmission (4) with adjustable clutches (67, 69), said control system comprising:

control and sensor devices (53, 54) for altering the engine speed and a degree of slip of said clutches (67, 69);

at least one control post (9, 10, 11) for selecting a direction of travel and a velocity of the ship by actuating at least one control lever (13) being connected to said at least one control post (9, 10, 11); and control electronics (21) for processing input and output signals;

wherein during an operational condition that serves to warm up said engine (3), said transmission (4) remains in a neutral position and the engine speed is adjusted via said at least one control lever (13).

29. A control system according to claim 28, wherein said operational condition that serves to warm up said engine (3) is engaged and disengaged, when said at least one control lever (13) is in a neutral position, by actuating a command key (35) of an input and output unit (16).

* * * * *